United States Patent [19]

Marui et al.

[11] 4,231,829

[45] Nov. 4, 1980

[54] PROCESS OF TRANSFER PRINTING

[75] Inventors: Toshio Marui; Masuo Masuda, both of Ibaraki, Japan

[73] Assignee: Nippon Gohsei Kagaku Kogyo Kabushiki Kaisha, Osaka, Japan

[21] Appl. No.: 35,986

[22] Filed: May 4, 1979

[30] Foreign Application Priority Data

May 16, 1978 [JP] Japan ..... 53-58567
May 25, 1978 [JP] Japan ..... 53-91076

[51] Int. Cl.[2] ..... B41M 3/12; B44C 1/16

[52] U.S. Cl. ..... 156/230; 156/83; 156/234; 156/240; 156/277; 427/149; 427/430.1; 427/434.3

[58] Field of Search ..... 156/83, 212, 230, 234, 156/235, 236, 238, 240, 246, 277, 285, 384, 475, 540, 541, 542, DIG. 37, 196, 232; 427/149, 280, 430 R, 434 A; 8/16, 147, 149

[56] References Cited

U.S. PATENT DOCUMENTS

| | | | |
|---|---|---|---|
| 618,672 | 1/1899 | Henry | 427/280 |
| 2,489,987 | 11/1949 | Barnola | 156/235 X |
| 2,817,225 | 12/1957 | Weglin | 427/280 |
| 2,981,632 | 4/1961 | Bennett | 427/280 |
| 3,554,834 | 1/1971 | Bennett et al. | 156/230 |
| 3,901,990 | 8/1975 | Solomon | 156/234 X |
| 3,933,561 | 1/1976 | Larson et al. | 156/246 |
| 4,010,057 | 3/1977 | Nakanishi et al. | 156/230 X |

*Primary Examiner*—Bruce H. Hess
*Attorney, Agent, or Firm*—Armstrong, Nikaido, Marmelstein & Kubovcik

[57] ABSTRACT

In a process of transferring a pattern printed on a thin film of a polyvinyl alcohol resin to a surface of an object by pressing the object to the thin film floated on the surface of the water with the printed surface faced up and submerging the object into the water, boric acid or salts thereof are included in the thin film or in the water. A clear and precise pattern can be transferred to the object even if it has uneven surface.

7 Claims, 2 Drawing Figures

PROCESS OF TRANSFER PRINTING

BACKGROUND OF THE INVENTION

The present invention relates to a process of transfer printing to apply a beautiful print onto uneven objects having grooves, projections, curved surface, etc.

There is known from U.S. Pat. No. 4,010,057 a printing apparatus wherein a thin film on which a pattern is printed is floated on the surface of a liquid and the pattern is transferred onto the surface of an object to be printed with the pattern utilizing the liquid pressure by submerging the object into the liquid while pressing the object onto the thin film (cf. Abstract of the Patent). The patent describes that it is the most preferable to use the farinaceous film as thin film, and in addition, the materials of the thin film can be polyacrylic acid soda, polyvinyl alcohol, methyl cellulose, carboxymethylcellulose, polyethylene oxide, polyvinylpyrrolidone and acrylic acid amide as synthetic high molecular substances; glue, gelatin, casein and polypeptide from among high molecular substances; starch, cellulose, dextrin, alubmin, soy bean protein, gum arabic and tragacanth gum from among vegetable high molecular substances; and sea weed glue, Japanese gelatin and alginic acid soda among sea weed high molecular substances.

However, the thin film made of the above-mentioned materials does not show a strength and elongation sufficient for multi-color printing, a good swellability, namely a good extensibility on the surface of the water as explained after and a large flexibility and softening property, so that the thin film is hard to closely adhere to an uneven surface of an object to be printed. Among a large number of materials listed above, the only practically usable material is a polyvinyl alcohol resin.

The thin film of a polyvinyl alcohol resin also has the following defects. That is, since the thin film largely extends and often partially dissolves in water to be torn and scatters when floated on the surface of the water, a pattern printed on the thin film is hard to be accurately transferred to the object. Also, since the period suitable for pressing an object to be printed onto the thin film is short, mistransfer is easy to occur. Further, in case of printing an object having a complicated curved surface, an acute part or a concave part, a spherical object or a longitudinally lengthy object, cutting, disturbance or overlapping of a printed pattern may occur.

OBJECTS OF THE INVENTION

It is an object of the present invention to provide a process of accurately and clearly transferring a printed pattern from the surface of a thin film onto the surface of an object to be printed by controlling the extension of the thin film floated on the surface of the water.

A further object of the invention is to provide a process of transferring a printed pattern in which an allowable period for processing is long and the transfer operation is easy.

A still further object of the invention is to provide a process of trasferring a printed pattern onto an object having a complicated curved surface without causing the cutting, disturbance and overlapping of the pattern.

These and other objects of the invention will become apparent from the description hereinafter.

DETAILED DESCRIPTION

Figure 1:
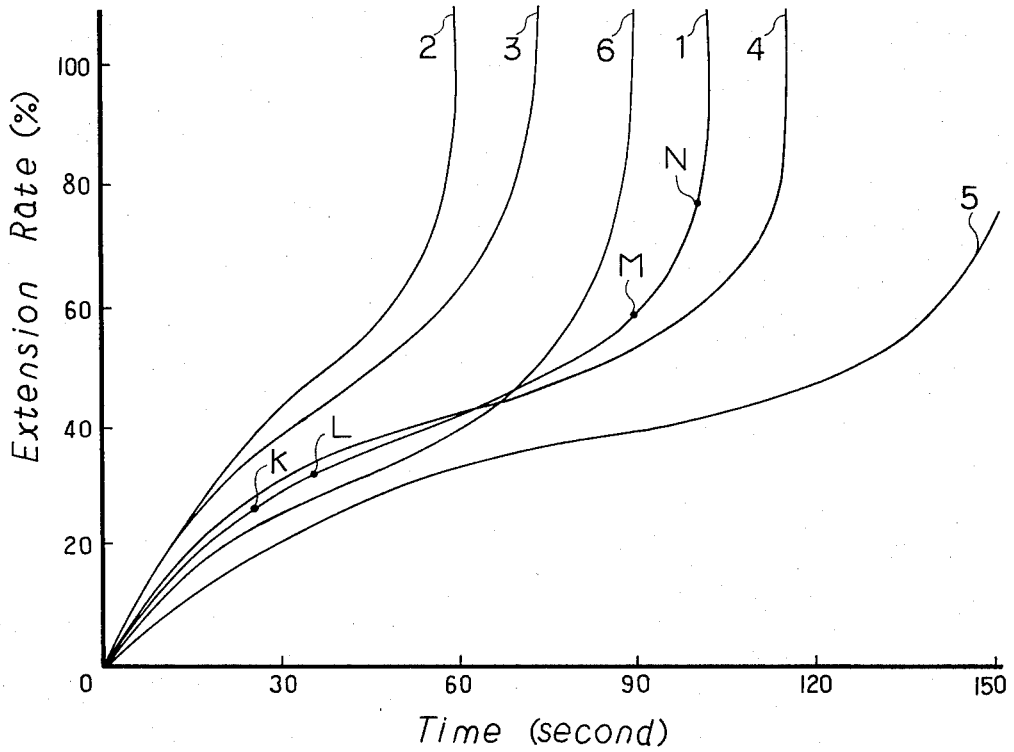
FIGS. 1 and 2 are graphs showing extension curves of thin films.

It has now been found that the above-mentioned objects can be attained by making boric acid or its salt include in a thin film of a polyvinyl alcohol resin or in water, in a process of transferring a pattern printed on a thin film of a polyvinyl alcohol resin to a surface of an object by pressing the object to the thin film floated on the surface of the water with the printed surface faced up and submerging the object into the water. That is to say, in accordance with the present invention, (i) a thin film of a polyvinyl alcohol resin including 0.02% to 10% by weight, preferably 0.1% to 2% by weight of boric acid or its salt based on the polyvinyl alcohol resin is floated on the surface of the water, and the transfer printing is conducted (hereinafter referred to as "embodiment X"), or (ii) a thin film of a polyvinyl alcohol resin is floated on the surface of the water including 0.002% to 0.5% by weight of boric acid or its salt, and the trasfer printing is conducted (hereinafter referred to as "embodiment Y").

The term "boric acid or its salt" as used herein means boric acid shown by the formula, $H_3BO_3$, borax shown by the formula, $Na_2B_4O_7 \cdot 10H_2O$ and anhydrous borax shown by the formula, $Na_2B_4O_7$, and borates other than sodium borate can also be employed in the present invention.

By adopting such processes, the following excellent effects can be exhibited in the transfer printing on industrial scale.

(1) Since the thin film employed in the invention has a tensile strength of not less than 1.0 kg./cm. and an elongation of not more than 200% at ordinary temperature and humidity (20° C., 65% RH), and no curl and good dimensional stability, the present invention is suitable for multi-color printing operation.

(2) The pattern-printed thin film smoothly extends on the surface of the water without curl, and an allowable period for processing is long and the transfer operation is easy.

(3) The thin film has a good extensibility and softness on the surface of the water, a pattern printed on the thin film is transferred onto an object having an uneven surface without cutting, disturbance and overlapping of the pattern.

(4) Since extension of a thin film on the surface of the water is adequately controlled, there is no uncleanness of a printed pattern due to overextension of the pattern.

(5) The thin film closely adhered to the surface of an object to be printed can be easily removed from the surface by washing with water after transfer printing.

According to the present invention, a beautiful, clear print can be applied to objects not only having a plain surface but also having complicated curved surfaces.

Polyvinyl alcohol resins employed in the present invention are those having an average degree of polymerization of 300 to 3,000 and an average degree of hydrolysis of 65% to 97% by mole. When the average degree of polymerization is less than 300, the film strength, particularly the film strength on the surface of the water is very low and, therefore, the film bursts and the transferred pattern is disturbed. When the average degree of polymerization is more than 3,000, the film strength is too high and the film lacks in wearability, wherein the term "wearability" means a characteristic of the film that the film follows accurately to any surface of an object and adheres that surface without tear, wrinkle and fold at the time of pressing the object to the film and submerging it into water. Also, when the average degree of hydrolysis is less than 65% by mole, the film lacks in extensibility, flexibility and wearability. On the other hand, when the average degree of hydrolysis is more than 97% by mole, since the film curls at the time of floating it on the surface of the water and also lacks in extensibility and flexibility on the surface of the water, it lacks in wearability upon the transfer operation, and moreover the removal of the film by washing with water after transfer operation is difficult.

The polyvinyl alcohol resins may be employed singly or in admixture thereof. In case of employing two or more kinds of polyvinyl alcohol resins, the average degrees of polymerization and hydrolysis of a mixture thereof should fall within the above-mentioned ranges.

Modified polyvinyl alcohol resins having the above-mentioned average degrees of polymerization and hydrolysis may also be employed in the present invention. Examples of the modified polyvinyl alcohol resin are hydrolyzed copolymers of a vinyl ester with an unsaturated carboxylic acid or its ester or salt, an unsaturated sulfonic acid or its salt, an $\alpha$-olefin having 2 to 20 carbon atoms, an unsaturated amide, an unsaturated nitrile, a vinyl ether, or vinyl chloride, and polyvinyl alcohol resins post-modified by acetalization, urethanation, esterification, etherification or graft polymerization.

The thin film is prepared by employing the above-mentioned polyvinyl alcohol resin (A) alone, or preferably in combination with the following component ($B_1$) and/or component ($B_2$).

The component ($B_1$) is selected from starches such as starch, modified starches, dextrin and enzyme-treated starches, alginic acid salts such as sodium alginate and xanthan gum. The combination of the polyvinyl alcohol resin and the component ($B_1$) improves elongation and the printability of the thin film. Moreover, the component ($B_1$) contributes to the lowering of the extension rate and the improvement of the wearability. However, the use of more than 50% by weight of the component ($B_1$) makes the thin film fragile and remarkably lowers the strength of the thin film and, therefore, the thin film having a strength sufficient for pattern-printing thereon cannot be obtained.

The component ($B_2$) is selected from polyacrylamide, polyethylene oxide and methyl cellulose. Copolymers of acrylamide and an acrylic acid salt are preferred rather than homopolymer of acrylamide. The component ($B_2$) is employed in an amount of not more than 50% by weight, and the use of more than 50% by weight of the component ($B_2$) lowers the film strength and the obtained thin film is poor in printability and transferability.

The component (A) is employed in an amount of not less than 50% by weight. When the amount of the component (A) is less than 50% by weight, the film strength is too low, and the thin film is poor not only in printability, but also in extensibility upon floating it on the surface of the water.

The functions of the components ($B_1$) and ($B_2$) are different to some extent. The component ($B_1$) tends to control the rigidity and elasticity of the thin film, and improve the printability and transferability. The component ($B_2$) tends to increase the adhesiveness of the thin film, and improve the wearability in transfer operation. However, the function of each component is not so definite as the above-mentioned, and each of the components organically combines with so as to show functions desirable as the thin film for transfer printing.

In case of employing the component (A) in combination with the component ($B_1$) and/or the component ($B_2$), these components are employed in amounts within the following ranges.

| | | % by weight |
|---|---|---|
| Component (A) | | 98 to 50 |
| Component ($B_1$) | 0 to 50 | total 2 to 50 |
| Component ($B_2$) | 0 to 50 | |

When at least one of the components ($B_1$) and ($B_2$) is present in an amount of not less than 2% by weight, the elongation of the film is adequately controlled so that the printability, particularly the printability for multicolor printing is improved and moreover the wearability of the film onto an object is improved. More preferable results are obtained, when three components (A), ($B_1$) and ($B_2$) are employed in amounts within the following ranges.

| | | % by weight |
|---|---|---|
| Component (A) | | 98.5 to 50 |
| Component ($B_1$) | 1 to 49.5 | total 1.5 to 50 |
| Component ($B_2$) | 0.5 to 49 | |

The most preferable results are obtained, when the three components (A), ($B_1$) and ($B_2$) are employed in amounts within the following ranges.

| | | % by weight |
|---|---|---|
| Component (A) | | 96 to 50 |
| Component ($B_1$) | 3 to 30 | total 4 to 50 |
| Component ($B_2$) | 1 to 30 | |

However, in practical use the thin film made of two components, e.g. the components (A) and ($B_1$) is sufficiently applicable to an object having considerably complicated curved surfaces or uneven parts.

In addition to the above-mentioned components (A), ($B_1$) and ($B_2$) which constitute the film substrate, there may be employed, as occasion demands, other water-soluble polymeric materials, softening agents for the polyvinyl alcohol resin component (A) such as polyhydric alcohols, polysaccharides, surface active agents, slipping agents, pH controlling agents such as acids, alkalis and salts, and fillers.

The thin film is formed in general by casting an aqueous solution of the above-mentioned components, but an extrusion process may also be applicable. In case of making boric acid or its salt include in the film, it is added to the film-forming composition.

It is desirable that the surface of the thin film is smooth, since a pattern is printed thereon, but a surface processing such as a satin treatment or an emboss treatment may be conducted on one or both sides of the thin film.

The thickness of the thin film is selected from 0.01 to 0.1 mm., preferably 0.015 to 0.07 mm. The thin film having a thickness of less than 0.01 mm is poor in strength and, therefore, not only the printability is impaired, but also the thin film is dissolved in water in a short time at a transferring step, so a time allowable for the transferring is limited into a narrow range and moreover the film is easy to burst. On the other hand, when the thickness is more than 0.1 mm., the difference in water content between both sides of the thin film floated on the surface of the water becomes so large that the film curls on the surface of the water and transfer printing cannot be carried out. Also, a laminated film in which two or more sheets of the film are laminated into one sheet may also be employed in the present invention.

The pattern printing onto the thin film may be carried out by any known printing processes.

The extension curve of a film is explained below.

Curve 1 in FIG. 1 shows a typical extension behavior of a thin film floated on the surface of the water.

Figure 2:
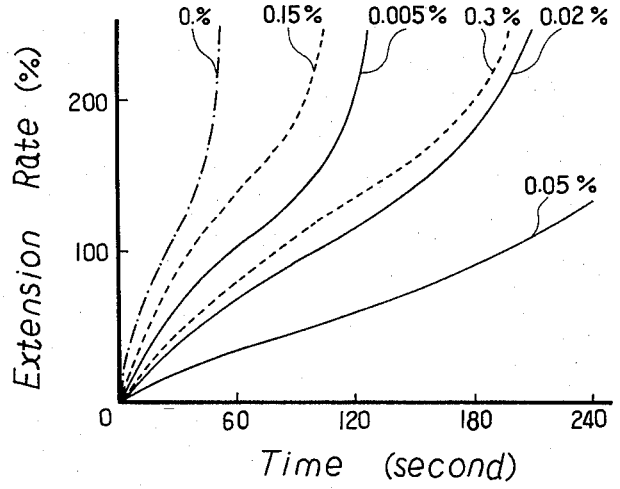

The term "extension rate" as used in FIGS. 1 and 2 and the specification means the rate of increase of the length of a film when the film is floated on the surface of the water, on which the film extends in all directions, and is calculated according to the following equation.

$$\frac{(\text{Length of Extended Film}) - (\text{Length of Original Film})}{(\text{Length of Original Film})} \times 100$$

The thin film extends in all directions when it is floated on the surface of the water. It extends rapidly between the points O and K, and rather slowly between the points L and M, and extends very rapidly after passing though the point N to dissolve or scatter. In the stage between the points O and K, since the film is not yet sufficiently swollen and softened, the reproducible transferring cannot be carried out. Also, in the stage after passing through the point N, since the film strength becomes weak, it is impossible to carry out the transferring without tear. The transfer printing may be started at any stage after passing through the point K, preferably the stage between the point L at a some distance from the point K and the point M. The thin film having a long stage between the points L and M allows a sufficient period for processing and contributes for a precise and reproducible transferring. A region extending from the point K to the point M, especially from the point L to the point M is hereinafter referred to as "transferable region". Therefore, the longer the time from the point L till the point M, the easier the transfer operation. For instance, the transferable region may become more than 20 seconds by using the thin film including boric acid or its salt, which is an enough time to transfer a pattern.

The extension curve of the thin film varies depending on the kind and amount of boric acid or its salt, film thickness, kind of the polyvinyl alcohol resin component (A), presence of other polymeric material than the component (A) such as the components ($B_1$) and ($B_2$), and temperature of water.

According to the present invention, the extension rate can be controlled low. For instance, in case of the thin film including boric acid or its salt, the extension rate is at most about 60%. An excessively large extension of a thin film makes a printed pattern unclear and unprecise.

The wearability test is explained below.

When an uneven object to be printed is pressed onto the printed surface of a pattern-printed thin film floated on the surface of the water and is submerged into water in the transferable region, the thin film closely adheres to the object along the uneven surface of the object by the liquid pressure. As a simple method for estimating this property, namely the wearability, the following testing method is applied. A cup of a truncated cone shape having a bottom and a groove (namely having a diameter of the base: 65 mm., diameter of the top: 90 mm., height: 250 mm., and having a slit of 2 mm. in width and 1 mm. in depth at the position of 50 mm. from the bottom) is used as a standard object. The bottom of the cup is pressed to a thin film floated on the surface of the water and submerged into water at a speed of 20 cm./min., after when the thin film has extended to the point L through the point K. The wearability of a thin film can be easily estimated by a vertical distance from the bottom to a point causing a defect such as tear, wrinkle or folding, namely to a wearability blocking point. The transferability to a very uneven surface, a curved surface of small curvature or a narrow groove can also be estimated by the state of a thin film onto the slit part of the cup in this test.

According to the present invention, the thin film uniformly adheres onto all over the surface of the cup, even to the slit part, and a good wearability of a thin film can be obtained. The vertical distance from the bottom to the wearability blocking point is not less than 80 mm., especially 100 mm., and this shows that a thin film sufficiently closely adheres to an object to be printed having a complicated uneven surface in practical use.

In the embodiment X, the thin film made of the component (A) alone or a mixture of the component (A) and at least one of the components ($B_1$) and ($B_2$) in which boric acid or its salt is included is employed in the transfer printing.

The amount of the boric acid or its salt is selected from 0.02% to 10% by weight, preferably 0.1% to 2% by weight, based on the polyvinyl alcohol resin component (A), and in case of the salt hydrates, the amount is calculated exclusive of the crystal water. When the amount of the boric acid or its salt is less than 0.02% by weight, the transferable region is narrow and also the extension rate becomes so large that a pattern transferred onto an object is unclear. On the other hand, when the amount of the boric acid or its salt is more than 10% by weight, an adequate flexibility is not obtained, so the wearability is lowered and overlapping of a printed pattern due to wrinkles take place.

In the embodiment X, the boric acid or its salt may be included into a thin film by the following two processes $X_1$ and $X_2$.

In the process $X_1$, the boric acid or its salt is added to a film-forming composition and a thin film is then formed. If necessary, pH of a film-forming composition may be adjusted by employing an alkali or an acid. For instance, in case of employing boric acid or its salt in the lower range, an alkali may be added to a film-forming composition, and in case of employing in the higher range, an acid may be added.

In another process $X_2$, a solution of boric acid or its salt is applied to one or both sides of a polyvinyl alcohol resin thin film or a thin film mainly composed of the polyvinyl alcohol resin. The thin film so applied with the solution is substantially the same as the thin film according to the precess $X_1$, since the applied boric acid or its salt penetrates into the inside of the thin film. The application of the solution onto the surface of the thin film is conducted by roll coating, brushing, spraying, dipping, doctor knife coating, or other known means. The application is conducted by employing a solution of boric acid or its salt in water, an organic solvent or a mixed solvent of water and an organic solvent. After applying the solution to the thin film, in general drying is carried out, but undried or semi-dried thin film may also be usable in the transfer operation.

In a still further embodiment Y, the transfer printing is carried out by floating a polyvinyl alcohol resin thin film or a thin film mainly composed of the polyvinyl alcohol resin on the surface of the water containing 0.002% to 0.5% by weight of boric acid or its salt, and then pressing an object to be printed to the thin film and submerging the object into water. FIG. 2 shows an extension behavior of a thin film of 25λ in thickness made of polyvinyl alcohol having an average degree of polymerization of 1,400 and an average degree of hydrolysis of 86.5% by mole when the thin film is floated on the surface of an aqueous solution of boric acid or borax in various concentrations at 25° C., in which solid lines show the extensibility on an aqueous solution of boric acid, dotted lines show the extensibility on an aqueous solution of borax and a dot-dash-line shows the extensibility on water.

The concentration of boric acid or its salt in its aqueous solution is selected from 0.002% to 0.5% by weight. In particular, the case of boric acid, the concentration is selected from 0.02% to 0.5% by weight, and in case of borax, the concentration is selected from 0.002% to 0.1% by weight. A too low concentration produces no improvement, and on the other hand, a too high concentration impairs the swelling and softening of the thin film and a desired wearability cannot be obtained.

The above-mentioned embodiments X and Y may be combined. In that case, the amount of boric acid or its salt present inside of the thin film or in water may be smaller to some extent as compared with the case adopting one embodiment.

The transfer printing is carried out according to the embodiment X or Y by floating a pattern-printed thin film on the surface of the water with the printed surface faced up, and then pressing an object to be printed to the printed surface and submerging the object into water when the thin film is in the transferable region. The thin film is closely adhered to the surface of the object and the pattern printed on the thin film is transferred onto the surface of the object by a liquid pressure. The pattern-printed thin film may be employed as it is, or in case that an ink layer of the pattern-printed thin film is hard, the thin film may be floated on the surface of the water after applying a solvent to the printed surface to provide a flexibility necessary for the transfer operation.

After the completion of the transfer operation, the residue of the thin film is removed from an object by washing with water in any manners such as immersion of the object into water or flowing water, blowing of jetted water, showering of water, or light brushing with bringing into contact with water. If necessary, acids, alkalis, surface active agents, enzymes, or coagulants or gelation agents for polyvinyl alcohol resins may also be added to the washing water. In such a manner, the film remaining on the surface of the object can be readily removed so that only printed pattern remains on the surface of the object. After the completion of the transfer printing, a surface finishing may be further carried out by applying a top coating to the pattern-transferred surface of the object in order to protect the surface.

The present invention is more particularly described and explained by means of the following Examples, in which all % and parts are by weight unless otherwise noted. Also, the amount for borax is described by part calcurated exclusive of the crystal water.

EXAMPLE 1

Polyvinyl alcohol having an average degree of polymerization of 1,400 and an average degree of hydrolysis of 88.5% by mole (A)—100 parts
Starch ($B_1$)—10 parts
Borax—0.7 part
Dipropylene glycol—4 parts The above three components were dissolved in water to give a 20% aqueous solution thereof, and a thin film having a thickness of 0.035 mm. was prepared by a drum casting method at a drum temperature of 95° C. A wood grain pattern was printed on the thin film by a rotogravure method.

After applying a prescribed amount of butyl cellosolve to the printed surface, the pattern-printed thin film was floated on the surface of the water at 30° C. with the printed surface faced up, and the extension rate of the film was measured. The extension curve obtained is shown by curve 1 in FIG. 1. The time between the points L and M which was the optimum region for starting the transfer operation was 55 seconds, and the time of extending up to 30% in extension rate was 30 seconds.

Another sheet of the pattern-printed thin film was floated on the surface of the water, and the wearability test was carried out. When the extension rate became 30%, a truncated conical cup of 65 mm. in diameter of the base, 90 mm. in diameter of the top and 250 mm. in height having a bottom and a slit of 2 mm. in width and 1 mm. in depth at the position of 50 mm. from the bottom, namely the standard object was pressed to the thin film floated on the surface of water with bringing the bottom into contact with the film and was submerged into water at a speed of 20 cm./min. The grain pattern was transferred onto all over the base and side of the cup and no lap of the thin film was observed.

After the wearability test, the thin film adhered to the cup was dissolved and removed with ease by showering a water of ordinary temperature onto the cup so that only grain pattern remained on all over the base and side of the cup.

The results of the film-forming property, printability for multi-color printing and transferability are shown in Table 1.

EXAMPLE 2

The procedure of Example 1 was repeated except that the component ($B_1$) was not employed.

The results are shown in Table 1.

COMPARATIVE EXAMPLE 1

A thin film having a thickness of 0.035 mm. was formed from a 20% aqueous solution of polyvinyl alcohol having an average degree of polymerization of 1,400 and an average degree of hydrolysis of 88.5% by mole. A wood grain pattern was printed on the film, but the change in elongation at the time of printing was large and, therefore, the registering in multi-color (four color) printing was conducted with difficulty and a shear in printing occurred.

After pattern-printing, the measurement of extension rate, wearability test and water washing were conducted in the same manner as in Example 1. The extension curve of the film is curve 2 shown in FIG. 1. The time between the points L and M was about 15 seconds. In the wearability test, tear was observed at the position of 45 mm. from the bottom of the cup and the grain pattern remarkably extended from the position near 30 mm. because of high extension rate, so no accurate transferring of the pattern was obtained. The film adhered onto the cup was readily removed by washing with water.

The results are shown in Table 1.

COMPARATIVE EXAMPLE 2

Polyvinyl alcohol having an average degree of polymerization of 1,400 and an average degree of hydrolysis of 88.5% by mole (A)—100 parts Starch ($B_1$)—10 parts The above two components were dissolved in water to give a 20% aqueous solution thereof, and a thin film having a thickness of 0.035 mm. was formed and printed with a wood grain pattern in the same manner as in Example 1. The extension rate, wearability and removability by water washing of the pattern-printed film were measured in the same manner as in Example 1. The extension curve is curve 3 shown in FIG. 1. The time between the points L and M was about 20 seconds. In the wearability test, tear by dissolution was observed at the position of 60 mm. from the bottom of the cup and the grain pattern remarkably extended from the position near 30 mm. because of high extension rate, so no accurate transferring of the pattern was observed. The removability by water washing of the film was good.

The results are shown in Table 1.

EXAMPLE 3

Polyvinyl alcohol having an average degree of polymerization of 1,700 and an average degree of hydrolysis of 88.2% by mole (A)—100 parts Glycerin (softening agent for film)—10 parts Boric acid—0.5 part Non-ionic surface active agent—0.2 part The above three components were dissolved in water to give a 20% aqueous solution thereof, and a thin film having a thickness of 0.035 mm. was formed and printed with a wood grain pattern in the same manner as in Example 1.

The pattern-printed thin film was floated on the surface of the water at 30° C. and the extension rate of the film was measured. The extension curve obtained is shown by curve 4 in FIG. 1.

Another sheet of the pattern-printed thin film was floated on the surface of the water, and when the extension rate reached 35%, the wearability test was carried out in the same manner as in Example 1. The grain pattern was transferred onto all over the surface of the cup without lap, and after the completion of the test, only film was readily dissolved and removed by showering water to the cup.

The results are shown in Table 1.

EXAMPLE 4

Polyvinyl alcohol having an average degree of polymerization of 1,700 and an average degree of hydrolysis of 88.2% by mole—80 parts Polyvinyl alcohol having an average degree of polymerization of 1,200 and an average degree of hydrolysis of 96.5% by mole—20 parts Borax—0.5 part Diglycerin—3 parts The above components were dissolved in water to give a 17% aqueous solution thereof, and a thin film having a thickness of 0.035 mm. was formed and printed with a wood grain pattern in the same manner as in Example 1.

The pattern-printed thin film was floated on the surface of the water at 30° C. with the printed surface faced up, and the extension rate of the film was measured. The extension curve obtained is shown by curve 5 in FIG. 1. The time between the points L and M was 90 seconds, and the time till the extension rate reached 30% was 50 seconds.

The wearability test was conducted in the same manner as in Example 1. The grain pattern was transferred onto all over the surface of the cup without lap. The removability by water washing of the film was also easy.

The results are shown in table 1.

COMPARATIVE EXAMPLE 3

Polyvinyl alcohol having an average degree of polymerization of 1,700 and an average degree of hydrolysis of 88.2% by mole—65 parts Polyvinyl alcohol having an average degree of polymerization of 1,200 and an average degree of hydrolysis of 96.5% by mole—35 parts The above components were dissolved in water to give a 20% aqueous solution thereof, and a thin film having a thickness of 0.035 mm. was formed and printed with a wood grain pattern.

The extension rate, wearability and removability by water washing of the film adhered to the surface of the object were measured in the same manner as in Example 1. The extension curve of the film is curve 6 shown in FIG. 1. The time between the points L and M was relatively long, but in the wearability test, pleat-like laps of the film were observed at the part higher than 30 mm. from the bottom of the cup and also the film was torn at the position of 80 mm. from the bottom because of lack in elongation. The removability by water washing of the film was good, but noticeable overlapping and peeling off of the pattern were seen at the above lap part and at the part higher than about 40 mm. from the bottom where the pattern-printed film did not well closely adhere to the cup.

The results are shown in Table 1.

Extension curves of films obtained in the above Examples and Comparative Examples are shown in FIG. 1 as follows:

Curve 1: thin film of Example 1

Curve 2: thin film of Comparative Example 1

Curve 3: thin film of Comparative Example 2

Curve 4: thin film of Example 3

Curve 5: thin film of Example 4

Curve 6: thin film of Comparative Example 3

TABLE 1

| | Film formation — | Printability for multi-color printing (possible number of colors) — | Transferability: Point K Extension rate % | Point K Time sec. | Time L→M (Transferable time) sec. | Extension rate at the time of starting transfer operation % | Presence of trouble such as lap and tear — | Wearability blocking point (height from the bottom) mm | Removability of film by water washing — |
|---|---|---|---|---|---|---|---|---|---|
| Ex. 1 | easy | 4 or more | 27 | 25 | 35→90 (55) | 30 | none | 180 | easy |
| Ex. 2 | easy | 4 or more | 30 | 25 | 35→80 (45) | 35 | none | 150 | easy |
| Com. Ex.1 | easy | 2 | 40 | 25 | 40→55 (15) | 50 | tore in early time | 45 | easy |
| Com. Ex. 2 | easy | 4 or more | 30 | 20 | 30→50 (20) | 40 | large extension | 60 | easy |
| Ex. 3 | easy | 4 or more | 32 | 30 | 40→100 (60) | 35 | none | 200 | easy |
| Ex. 4 | easy | 4 or more | 28 | 45 | 50→140 (90) | 30 | none | >200 | easy |
| Com. Ex. 3 | easy | 4 or more | 25 | 30 | 40→70 (30) | 30 | lap and tear | 30 to 50 | easy |

EXAMPLES 5 to 8

An aqueous solution of the following components was prepared to give a film-forming composition to which 6% of dipropylene glycol and 0.4% of a nonionic surface active agent were further added as a softening agent and a modifier, based on the resin. From the composition, a thin film having a thickness of 0.035 mm. was formed and printed on its one surface with a marble pattern. After applying a prescribed amount of butyl cellosolve acetate to the printed surface, the wearability test was conducted in the same manner as in Example 1.

The results are shown in Table 2.

Components for Example 5

Polyvinyl alcohol having an average degree of polymerization of 1,700 and an average degree of hydrolysis of 77.8% by mole (A)—95 parts
Polyethylene oxide having a molecular weight of 4,000,000 ($B_2$)—5 parts
Borax—0.5 part Components for Example 6

Polyvinyl alcohol having an average degree of polymerization of 1,700 and an average degree of hydrolysis of 88.2% by mole (A)—75 parts
White dextrin ($B_1$)—20 parts
Methyl cellulose ($B_2$)—5 parts
Borax—1 part Components for Example 7

Polyvinyl alcohol having an average degree of polymerization of 700 and an average degree of hydrolysis of 92.0% by mole (A)—100 parts
Boric acid—1 part Components for Example 8

Polyvinyl alcohol having an average degree of polymerization of 1,700 and an average degree of hydrolysis of 88.2% by mole (A)—90 parts
Polyacrylamide having an average molecular weight of 2,000,000 ($B_2$)—10 parts
Borax—0.3 part

TABLE 2

| | Film formation — | Printability for multi-color printing (possible number of colors) — | Transferability: Point K Extension rate % | Point K Time sec. | Time L→M (Transferable time) sec. | Extension rate at the time of starting transfer operation % | Presence of trouble such as lap and tear — | Wearability blocking point (height from the bottom) mm. | Removability of film by water washing — |
|---|---|---|---|---|---|---|---|---|---|
| Ex. 5 | easy | 4 or more | 28 | 26 | 40→120 (80) | 30 | none | >200 | easy |
| Ex. 6 | easy | 4 or more | 25 | 35 | 50→105 (55) | 25 | none | 180 | easy |
| Ex. 7 | fairly easy | 4 or more | 23 | 40 | 50→100 (50) | 25 | none | 160 | easy |
| Ex. 8 | easy | 4 or more | 27 | 25 | 35→75 (40) | 30 | none | 130 | easy |

EXAMPLE 9

A thin film having a thickness of 0.045 mm. was formed from a 20% aqueous solution of polyvinyl alcohol having an average degree of polymerization of 1,400 and an average degree of hydrolysis of 86.5% by mole by a drum casting method at a drum temperature of 95° C., and a wood grain pattern was printed on its surface by a rotogravure method.

The pattern-printed thin film was floated on the surface of a 0.02% aqueous solution of borax at 25° C. with the printed surface faced up, and the wearability test was conducted by pressing the bottom of the standard cup to the thin film after 140 seconds (extension rate of film: 45%) and submerging the cup into the solution at a speed of 20 cm./min. The grain pattern was transferred to all over the base and side of the cup and no lap of the film was observed.

After the completion of the wearability test, the film adhered to the cup was dissolved and removed with ease by showering water of ordinary temperature onto the cup so that only gran pattern was made to remain.

The results are shown in Table 3.

COMPARATIVE EXAMPLE 4

The wearability test of Example 9 was repeated except that the pressing and submerging of the cup were started after 25 seconds (extension rate of film: 5%). Tear by dissolution of the film was observed at the position of 45 mm. from the bottom of the cup and the grain pattern remarkably extended from the position near 30 mm. because of high extension rate, so good accurate transferring of the pattern was not obtained. The removability of the film by washing with water was good.

The results are shown in Table 3.

EXAMPLE 10

The pattern-printed thin film of Example 9 was floated on the surface of a 0.03% aqueous solution of anhydrous borax at 25° C., and after 120 seconds (extension rate of film: 40%), the standard cup was pressed to the film and submerged into the solution.

The results are shown in Table 3.

EXAMPLE 11

The pattern-printed thin film of Example 9 was floated on the surface of a 0.1% aqueous solution of boric acid at 25° C., and after 80 seconds (extension rate of film: 100%), the standard cup was pressed to the film and submerged into the solution.

The results are shown in Table 3.

TABLE 3

| | Time of starting transfer operation sec. | Extension rate at the time of starting transfer operation % | Wearability blocking point (height from the bottom) mm. | Reproducibility of pattern — | Removability of film by water washing — |
|---|---|---|---|---|---|
| Ex. 9 | 130 | 45 | 140 | good | good |
| Com. Ex. 4 | 25 | 5 | 30–45 | bad | good |
| Ex. 10 | 120 | 40 | 135 | good | good |
| Ex. 11 | 80 | 100 | 143 | good | good |

EXAMPLE 12

The pattern-printed thin film having a thickness of 0.035 mm. obtained in Comparative Example 2 was floated on the surface of a 0.005% aqueous solution of borax at 25° C., and the transfer printing was then carried out in the same manner as in Example 9.

The results are shown in Table 4.

COMPARATIVE EXAMPLE 5

The procedure of Example 12 was repeated except that the pattern-printed thin film was floated on the surface of the water.

The results are shown in Table 4.

EXAMPLE 13

The procedure of Example 12 was repeated except that the pattern-printed thin film was floated on the surface of a 0.05% aqueous solution of borax at 30° C.

The results are shown in Table 4.

EXAMPLE 14

The procedure of Example 12 was repeated except that the pattern-printed thin film was floated on the surface of a 0.15% aqueous solution of boric acid at 30° C.

The results are shown in Table 4.

TABLE 4

| | Time of starting transfer operation sec. | Extension rate at the time of starting transfer operation % | Wearability blocking point (height from the bottom) mm. | Reproducibility of pattern — | Removability of film by water washing — |
|---|---|---|---|---|---|
| Ex. 12 | 40 | 65 | 150 | good | good |
| Com. Ex. 5 | 25 | 40 | 45 | slightly bad | good |
| Ex. 13 | 60 | 90 | 130 | good | good |
| Ex. 14 | 50 | 70 | 145 | good | good |

EXAMPLE 15

Polyvinyl alcohol having an average degree of polymerization of 1,700 and an average degree of hydrolysis of 88.2% by mole—80 parts Polyvinyl alcohol having an average degree of polymerization of 1,200 and an average degree of hydrolysis of 96.5% by mole—20 parts The above components were dissolved in water to give a 17% aqueous solution thereof, and a thin film having a thickness of 0.035 mm. was formed by a drum casting method at a drum temperature of 95° C. and was printed with a wood grain pattern by a known printing apparatus.

The pattern-printed thin film was floated on the surface of a 0.01% aqueous solution of borax at 25° C., and the transfer printing was then carried out in the same manner as in Example 9.

The results are shown in Table 5.

COMPARATIVE EXAMPLE 6

The procedure of Example 15 was repeated except that the pattern-printed thin film was floated on the surface of the water.

The results are shown in Table 5.

EXAMPLES 16 to 18

An aqueous solution of the following components was prepared to give a film-forming composition to which 6% of dipropylene glycol and 0.4% of a non-ionic surface active agent were further added as a softening agent and a modifier, based on the resin. From the composition, a thin film having a thickness of 0.035 mm. was formed and printed on its one surface with a marble pattern. After applying a prescribed amount of a solvent having an affinity for a printing ink to the printed surface, the film was immediately employed in the transfer printing.

Components for Example 16

Polyvinyl alcohol having an average degree of polymerization of 1,700 and an average degree of hydrolysis of 77.8% by mole (A)—95 parts Polyethylene oxide having a molecular weight of 4,000,000 ($B_2$)—5 parts

Components for Example 17

Polyvinyl alcohol having an average degree of polymerization of 1,700 and an average degree of hydrolysis of 88.2% by mole (A)—75 parts Sodium alginate ($B_1$)—20 parts Methyl cellulose ($B_2$)—5 parts

Components for Example 18

Polyvinyl alcohol having an average degree of polymerization of 1,700 and an average degree of hydrolysis of 88.2% by mole (A)—90 parts Xanthan gum ($B_2$)—10 parts The transfer printing was carried out by floating the film on the surface of a 0.01% aqueous solution of borax at 25° C., pressing the standard cup to the film and submerging into the solution.

The results are shown in Table 5.

TABLE 5

| | Time of starting transfer operation sec. | Extension rate at the time of starting transfer operation % | Wearability blocking point (height from the bottom) mm. | Reproducibility of pattern — | Removability of film by water washing — |
|---|---|---|---|---|---|
| Ex. 15 | 50 | 40 | 135 | good | good |
| Com. Ex. 6 | 20 | 25 | 30-50 | bad | good |
| Ex. 16 | 40 | 45 | 130 | good | good |
| Ex. 17 | 40 | 25 | 135 | good | good |
| Ex. 18 | 45 | 30 | 120 | good | good |

EXAMPLE 19

A 0.5% solution of borax in a water-methanol mixed solvent (1:1 by weight) was coated to the back of the pattern-printed thin film obtained in Example 9 and was dried by allowing the film to stand. The coating amount of borax was 0.5% based on the polyvinyl alcohol.

The thin film was then floated on the surface of water at 25° C. with the printed surface faced up, and after 50 seconds (extension rate of film: 30%), the wearability test was conducted by pressing the bottom of the standard cup to the thin film and submerging the cup into water. The grain pattern was transferred to all over the base and side of the cup and no lap of the film was observed.

After the completion of the wearability test, the film adhered to the cup was dissolved and removed with ease by showering a jetted water of ordinary temperature onto the cup so that only grain pattern was made to remain.

The results are shown in Table 6.

EXAMPLE 20

The procedure of Example 19 was repeated except that a 1.0% solution of boric acid in a mixed solvent of water and methanol (1:1 by weight) was coated on the pattern-printed thin film obtained in Example 12 in an amount of 6% based on the polyvinyl alcohol.

The results are shown in Table 6.

EXAMPLES 21 to 23

The procedure of Example 19 was repeated except that a 0.3% aqueous solution of borax was coated on each of the pattern-printed thin films obtained in Examples 15, 17 and 18 in an amount of 3% based on the polyvinyl alcohol and was dried by a hot air of 80° C.

The results are shown in Table 6.

TABLE 6

| | Time of starting transfer operation sec. | Extension rate at the time of starting transfer operation % | Wearability blocking point (height from the bottom) mm. | Reproducibility of pattern — | Removability of film by water washing — |
|---|---|---|---|---|---|
| Ex. 19 | 50 | 30 | 120 | good | good |
| Ex. 20 | 45 | 30 | 120 | good | good |
| Ex. 21 | 30 | 35 | 125 | good | good |
| Ex. 22 | 40 | 25 | 130 | good | good |
| Ex. 23 | 45 | 35 | 135 | good | good |

What we claim is:

1. In a process of transferring a pattern printed on a thin film of a polyvinyl alcohol resin to a surface of an object by pressing the object to the thin film floated on the surface of water with the printed surface faced up and submerging the object into the water, the improvement which comprises incorporating boric acid or its salts selected from the group consisting of borax, anhydrous borax and borates other than sodium borate into said thin film of polyvinyl alcohol resin or into said water; said resin having an average degree of polymerization of 300 to 3,000 and an average degree of hydrolysis of 65% to 97% by mole; said boric acid or its salt being incorporated in said film in an amount of 0.02% to 10% by weight based on the polyvinyl alcohol resin or in the water in a concentration of 0.002% to 0.5% by weight.

2. The process of claim 1, wherein said boric acid or its salt is incorporated into the thin film of a polyvinyl alcohol resin by means of admixing the boric acid or its salt with a film-forming composition and forming a thin film from the resulting mixture.

3. The process of claim 1, wherein said boric acid or its salt is incorporated into the thin film of a polyvinyl alcohol resin by means of applying a solution of boric acid or its salt to at least one side of the thin film.

4. The process of claim 1, wherein the thickness of said thin film is 0.01 to 0.1 mm.

5. The process of claim 1, wherein said thin film of a polyvinyl alcohol resin comprises 98% to 50% by weight of a polyvinyl alcohol resin component(A) and 2% to 50% by weight of at least one selected from a component ($B_1$) and a component ($B_2$) exclusive of the boric acid or its salt, said component ($B_1$) being at least one selected from the group consisting of starch, alginic acid salt and xanthan gum and said component ($B_2$) being at least one selected from the group consisting of polyacrylamide, polyethylene oxide and methyl cellulose.

6. The process of claim 5, wherein said thin film of a polyvinyl alcohol resin contains both of at least 1% by weight of the component ($B_1$) and at least 0.5% by weight of the component ($B_2$).

7. The process of claim 1, wherein the amount of boric acid or its salt included in the thin film falls within the range of 0.1% to 2% by weight.

* * * * *